United States Patent [19]

Grange

[11] Patent Number: 4,720,271

[45] Date of Patent: Jan. 19, 1988

[54] HERMETIC COAXIAL CONNECTOR

[75] Inventor: Pierre Grange, Charavines, France

[73] Assignee: Radiall Industrie, Rosny-Sous-Bois, France

[21] Appl. No.: 936,225

[22] Filed: Dec. 1, 1986

[30] Foreign Application Priority Data

Nov. 29, 1985 [FR] France ..... 85 17665

[51] Int. Cl.[4] ..... H01R 13/52

[52] U.S. Cl. ..... 439/271; 439/935; 439/578; 439/322; 439/559; 439/572

[58] Field of Search ..... 339/94, 60, 177 R, 177 E, 339/125, 126, 128–132; 174/152 SM

[56] References Cited

U.S. PATENT DOCUMENTS

| | | | |
|---|---|---|---|
| 2,423,277 | 7/1947 | Weissman | 339/126 J |
| 2,552,686 | 5/1951 | Melcher . | |
| 3,022,482 | 2/1962 | Waterfield et al. | 339/94 C |
| 3,936,125 | 2/1976 | Hutter . | |
| 3,998,515 | 12/1976 | Panek | 339/94 A |
| 4,173,385 | 11/1979 | Fennet et al. | 339/94 C |
| 4,227,765 | 10/1980 | Neumann et al. . | |

FOREIGN PATENT DOCUMENTS

| | | | |
|---|---|---|---|
| 28092 | 4/1964 | Fed. Rep. of Germany | 339/126 R |
| 0110823 | 10/1983 | Fed. Rep. of Germany . | |
| 0041023 | 5/1981 | France . | |

*Primary Examiner*—Gil Weidenfeld
*Assistant Examiner*—David Pirlot
*Attorney, Agent, or Firm*—Arnold, White & Durkee

[57] ABSTRACT

The invention concerns a hermetic coaxial connector of the type intended to be attached to a panel to ensure hermetic coaxial traverse of said panel, comprising a central conductive contact housed with interposition of an insulator in a housing, forming an external conductor, provided with means of attachment to a panel, a sealing joint between the external conductor and the panel, and an insulating glass bead sealed to the central contact and to an annular ring housed at least partly in a recess of the housing. The ring presents a staggered configuration comprising an axial annular span connected by the glass sealing bead (7) to central contact (5), an axial span in contact with a corresponding span of the housing, a radial span supported against the corresponding span of the housing and a radial span in contact with the sealing joint (11) interposed between the ring and the panel (2).

3 Claims, 4 Drawing Figures

HERMETIC COAXIAL CONNECTOR

BACKGROUND OF THE INVENTION

The present invention concerns a hermetic coaxial connector of the type intended to be fixed to a panel to ensure hermetic coaxial traverse of said panel.

Such coaxial connectors comprise a conductive central contact housed with interposition of an insulator in a housing that forms an outside conductor provided with means of attachment to a panel, a sealing joint between said housing and the panel, and a sealing device between the central contact and the outside conductor of the connector.

In connectors of a first type, those with so-called direct sealing, the sealing device is a glass bead that is directly sealed to the central contact and external housing. These connectors present the drawback of being too high in price because of the need to choose a material capable of sealing for the housing, such as ferronickel for example.

The housing so produced is fragile and can readily deteriorate during installation and/or disassembly of the connector on the corresponding panel, especially when the connector is of the screw type.

Moreover, because the housing is sealed by the glass bead to the central contact, it is not possible to replace merely the external conductor in the event of damage.

In addition, in this type of connector with direct sealing the sealing operation proper is relatively complex, requiring the use of graphite positioners that match the shapes of the external housing, the glass bead and the central contact.

The manufacturing cost of such connectors is therefore also high.

Another type of connector is also known, the so called mounted bead type, whose sealing device comprises an insulating glass bead sealed to the central contact and to an annular ring housed in a recess of the housing and attached to the latter by low temperature soldering.

Relative to the first type of connector mentioned above, the mounted bead connectors offer the advantage of using more conventional materials for the housing and thus materials of lower cost.

A very important drawback, on the other hand, resides in the need for a soldering operation which must be carried out at low temperature at about 200° C. in order to avoid degradation of sealing. For this soldering operation it is necessary to carry out preparation of the surface of the housing, which is a delicate operation that is difficult to automate and requires precise handling which leads to increased cost. Moreover, there are risks of appearance of a leakage path at the level of the soldering, which reduces the reliability of the connector.

In addition, as in the first type of connector with direct sealing, it is not possible because of soldering to replace the external conductor without replacing the entire connector in the event of damage.

The present invention proposes to provide a hermetic coaxial connector that precisely avoids the drawbacks of the previous connectors just mentioned, avoiding in particular the use of costly and fragile materials for the external housing, requiring no soldering operation on the housing and offering the advantage of permitting replacement of the housing without replacing other elements of the connector, if necessary.

The connector according to the invention comprises an insulating glass bead sealed to the central contact and to an annular ring housed at least partly in a recess of the housing, and is essentially characterized by the fact that said ring presents a staggered configuration containing an axial annular span connected via the glass sealing bead to the central contact, an axial span in contact with a corresponding span of the housing, a first radial span resting against a corresponding span of the housing and a second radial span in contact with the sealing joint interposed between the ring and panel.

One understands that the structure of the staggered ring according to the invention is in no way integral with the housing forming the external conductor, which permits easy changing of the latter in the event of damage.

Conventionally, the connectors according to the invention can be mounted by screwing them in a bore having a top and a bottom provided for this purpose in a panel, the housing forming the external conductor presenting for this purpose a threading, in which case the ring advantageously presents according to the invention a section of reduced diameter having a radial end span placed against a corresponding span of the bottom of the bore, the sealing joint being housed in a space defined by the bore of the panel, said section of reduced diameter of the ring and said second radial span of the ring forming the contact with the sealing joint.

As a variant the connectors according to the invention can present a collar attachment, in which case according to the invention one carries out installation of the ring integral with the bead in a corresponding recess of the external conductive housing, the sealing joint being housed in a space defined by the panel, the ring and the annular axial internal span of the collar.

Other characteristic advantages of the invention will appear on reading the following specification with reference to the accompanying drawing in which:

DETAILED DESCRIPTION OF THE PREFERRED EMBODIMENTS

Figure 1:
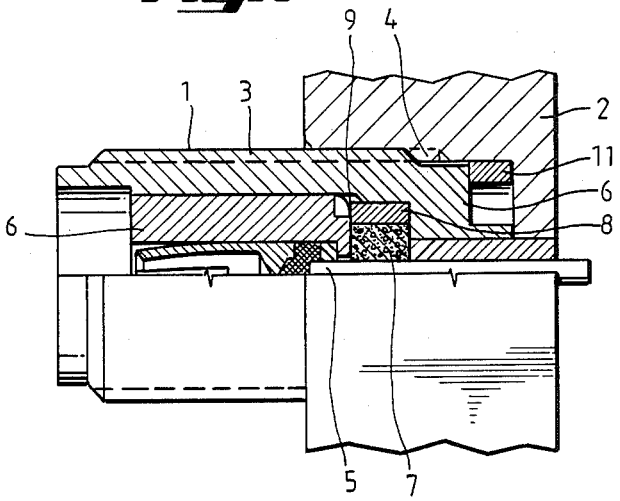
FIG. 1 is a half cross section of a conventional hermetic coaxial connector of the mounted type.

The conventional hermetic coaxial connector of the mounted bead type illustrated in FIG. 1 comprises a housing 1 forming an external conductor intended to be attached to a panel 2 and comprising on its outside periphery a threading 3 intended to cooperate with a corresponding screw thread 4 made in the hole provided in the panel for passage of the connector.

The connector contains a central contact denoted overall by 5 and an insulator 6 between the central contact 5 and the housing 1.

Sealing between the central contact 5 and housing 1 is ensured by an insulating glass bead 7 sealed to the central contact 5 and to an annular ring 8, itself integral with housing 1 by soldering 9.

Sealing between housing 1 and panel 2 is ensured by a sealing joint 11, for example a metal joint with limited crushing pressure.

Figure 2:
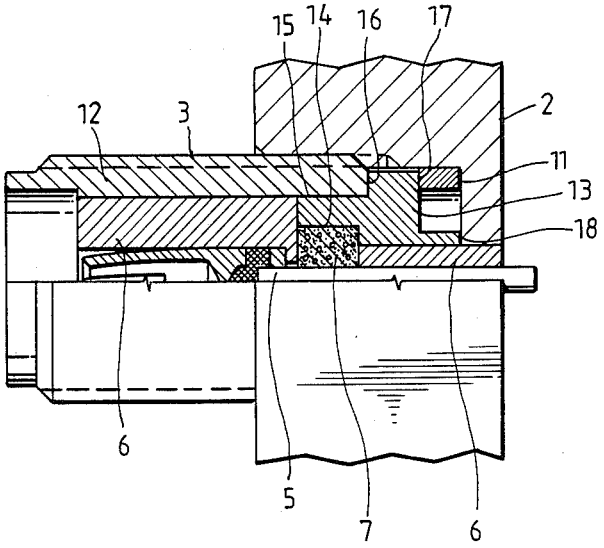
FIG. 2 is a view similar to that of FIG. 1 of a connector according to the invention according to a first version.

One is now referred to FIG. 2 which illustrates a first version of the hermetic connector according to the invention which presents in very general fashion the same outside appearance as the connector illustrated in FIG. 1.

One finds a central contact 5 housed with interposition of an insulator 6 in a housing 12 forming an external conductor, whose front part, intended to be positioned within the panel, nevertheless presents a structure slightly different from that of housing 1 of the connector illustrated in FIG. 1. The housing 12, like housing 1, is provided with threading 3 intended for installation by screwing of the connector on panel 2.

As in the connector of FIG. 1, a glass bead 7 is sealed to central contact 5 and to a ring 13 made, for example, of iron-nickel FN 42 (alloy Fe 48%-Ni 42%).

As seen in FIG. 2, the ring according to the invention presents a staggered structure with three outside diameters in the version shown and is extended to the sealing joint 11 housed in the bottom of the hole of the panel.

More specifically, the ring 13 contains a first section in which the internal axial span 14 is in sealing contact with the glass bead 7, and an axial span 15 in contact with a corresponding axial span of the housing 12.

This first section of the ring is extended by a section of greater outside diameter defining a first radial span 16 for the front end of housing 12 and a second radial span 17 for support against the sealing joint 11.

Finally, the ring contains an end part of reduced diameter having a radial span of end 18 placed against the bottom of the, bore of the panel. The sealing joint 11 being crushed between span 17 of the ring and the wall of the panel, thus preventing any leakage path between housing 12 and the panel.

Relative to the version of FIG. 1, one sees that soldering 9 was eliminated so that housing 12 is not sealed directly or indirectly to bead 7 and it is therefore possible to replace it without replacing the other components of the connector, especially in the case of damage to its threading 3.

Figure 3:
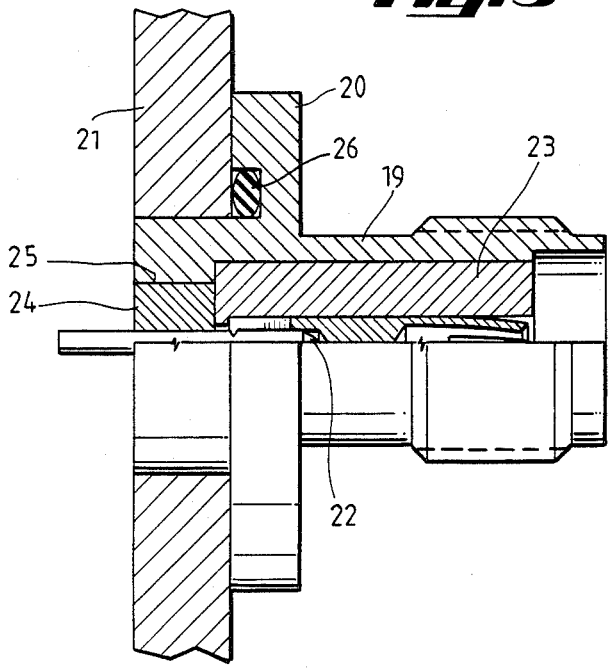
FIG. 3 is a half cross section of a conventional hermetic connect of the type with direct sealing and FIG. 4 is a view similar to that of FIG. 3 of a connector according to the second version of the invention.

One is now referred to FIG. 3 which illustrates a conventional hermetic connector of the type with direct sealing and attachment by a collar.

The connector contains a housing forming an external conductor 19 provided with an attachment collar 20 presenting orifices (not shown) for passage of attachment devices (not shown) on panel 21.

The connector contains a central contact denoted overall by 22, mounted in housing 19 with interposition of an insulator 23.

To avoid any leakage path between the central contact 22 and housing 19 a glass bead 24 is provided that produces direct sealing of an internal axial span 25 of housing 19 on central contact 22.

To avoid a leakage path between housing 19 and panel 21 a sealing joint 26 is provided, housed in a recess made in the collar of the housing.

To permit its adhesion to the glass bead 24 housing 19 overall is made of a material that presents good sealing characteristics, especially ferronickel. Because of the sealing made along span 25, the housing cannot be replaced in the event of damage without replacing the entire connector.

Figure 4:
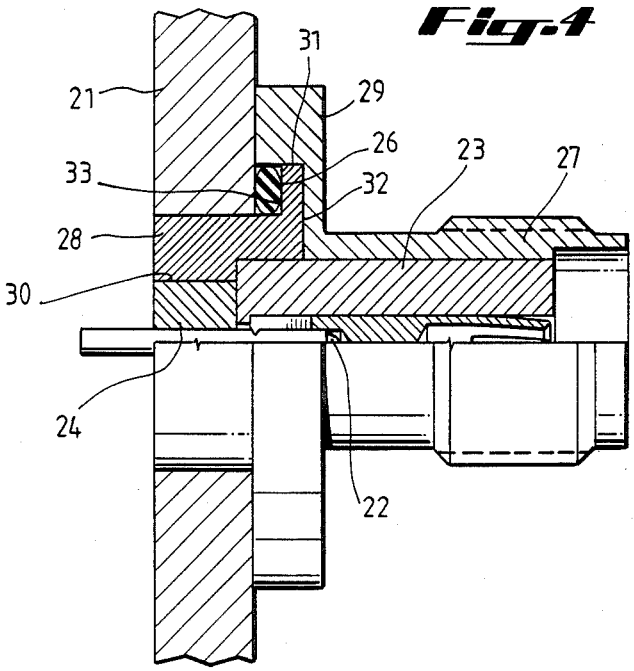

The connector according to the invention illustrated in FIG. 4 presents an overall appearance similar to that of the connector of FIG. 3, but differing on the one hand by the structure and the material of the housing 27 forming the external conductor and on the other hand by the presence of a ring with a staggered structure denoted overall with 28 and sealed to the bead 24 which itself is sealed to the central contact 22.

The housing 27, which can be made of a relatively readily available conventional material such as brass, as housing 12 of the version of FIG. 2, does not extend in the version of FIG. 3 into the bore made in panel 21, but merely contains a rear part prolonged by an attachment collar 29 to panel 21 by means not shown the attachment collar comprises an axial internal annular span as shown in FIG. 4.

The ring 28 of the connector according to the invention contains an internal axial annular span 30 which, like span 25 of housing 19 in the version of FIG. 3, makes contact with the sealing bead 24, an axial span 31 in contact with the axial internal annular span of the collar 29 of housing 27, a radial span 32 supported against a corresponding span of housing 27 and a radial span 33 in contact with the sealing joint 26 interposed between the ring and the panel.

The ring 28 with staggered structure according to the invention, which is seen in FIG. 4, is emplaced according to a hard installation in a recess made in housing 27 concentric to collar 29, the sealing joint 26 being housed in the space defined by the panel, the ring and the annular axial internal span of the collar, this sealing joint thus preventing any leakage between the ring and panel.

Because the housing 27 with its collar 29 is not integral with ring 28, it can be easily removed and replaced in the event of damage without requiring replacement of other components of the connector.

Although the invention has been described relative to particular versions, it is evident that it is in no way limited to them and numerous variants and modifications could be used without departing from its scope or spirit.

In particular, the invention can be used with connectors of the hermetic type presenting other means of attachment to a panel, for example attachment by a nut, the staggered configuration of the ring then being adapted to the particular structure of the connector.

What is claimed is:

1. A hermetic coaxial connector of the type intended to be attached to a panel to ensure hermetic coaxial traverse of a bore having a top and a bottom in said panel, comprising a central conductive contact housed with interposition of an insulator in a housing, forming an external conductor, provided with a means of attachment to said panel, a sealing joint between said external conductor and said panel and an insulating glass bead sealed to said central conductive contact and to an annular ring housed at least partly in a recess of said housing, characterized by the fact that said ring presents a staggered configuration containing an axial annular span connected via said insulated glass bead to said central conductive contact, an axial span in contact with a corresponding span of said housing, a first radial span supported against a corresponding span of said housing and a second radial span in contact with said sealing joint interposed between said ring and said panel.

2. A connector according to claim 1 of the type intended to be attached by a screwing means to a panel, characterized by the fact that said ring presents a section of reduced diameter having a radial end span placed against a corresponding span of the bottom of the bore of said panel, said sealing joint being housed in a space defined by the bore in said panel, said section of reduced diameter of the ring and said second radial span of the ring making contact with the sealing joint.

3. A connector according to claim 1 of the type intended to be attached by a collar having an axial internal annular span to a panel, characterized by the fact that said ring is housed in a corresponding recess of said housing (27); said sealing joint being housed in a space defined by said panel, said ring and the axial internal annular span of said collar.

* * * * *

UNITED STATES PATENT AND TRADEMARK OFFICE

CERTIFICATE OF CORRECTION

PATENT NO. : 4,720,271

DATED : January 19, 1988

INVENTOR(S) : Pierre Grange

It is certified that error appears in the above-identified patent and that said Letters Patent are hereby corrected as shown below:

Column 3, line 34, replace "the, bore" with -- the bore --.

Column 6, line 3, delete "(27)".

Signed and Sealed this

Twenty-seventh Day of September, 1988

*Attest:*

DONALD J. QUIGG

*Attesting Officer*

*Commissioner of Patents and Trademarks*